US010557239B1

(12) United States Patent
Malaney

(10) Patent No.: US 10,557,239 B1
(45) Date of Patent: Feb. 11, 2020

(54) INFLATABLE FLOOD BARRIER

(71) Applicant: Kevin Malaney, Niagara Falls, NY (US)

(72) Inventor: Kevin Malaney, Niagara Falls, NY (US)

( * ) Notice: Subject to any disclaimer, the term of this patent is extended or adjusted under 35 U.S.C. 154(b) by 0 days.

(21) Appl. No.: 16/357,434

(22) Filed: Mar. 19, 2019

(51) Int. Cl.
*E02B 3/10* (2006.01)
*E02B 3/12* (2006.01)
*E06B 9/00* (2006.01)

(52) U.S. Cl.
CPC ..... *E02B 3/12* (2013.01); *E06B 2009/007* (2013.01)

(58) Field of Classification Search
CPC ..... E02B 3/12; E02B 3/106; E06B 2009/007
See application file for complete search history.

(56) References Cited

U.S. PATENT DOCUMENTS 4,252,461 A * 2/1981 Colamussi ..... E02B 7/005 405/115
4,377,352 A * 3/1983 Goodstein ..... E02B 7/20 405/107
5,102,261 A * 4/1992 Gunderson, III ..... E02B 15/06 405/70
5,197,821 A * 3/1993 Cain ..... E02B 15/08 405/68
5,238,327 A * 8/1993 Blair ..... E02B 15/08 405/68
5,645,373 A 7/1997 Jenkins
5,865,564 A 2/1999 Miller
5,984,577 A * 11/1999 Strong ..... E02B 3/108 405/114
5,988,946 A * 11/1999 Reed ..... E02B 3/102 405/114
6,029,405 A 2/2000 Wood
6,164,870 A 12/2000 Baruh
6,551,025 B2 * 4/2003 Dery ..... E02B 3/108 405/115
6,726,405 B1 * 4/2004 Rørheim ..... E02B 3/108 405/107
7,491,016 B2 * 2/2009 Baruh ..... E02B 3/108 405/114
7,762,742 B1 7/2010 Smith
D631,977 S 2/2011 Taylor
9,453,314 B2 * 9/2016 Cadogan ..... E06B 9/0692
9,708,785 B1 * 7/2017 Bollman ..... E02B 3/108
(Continued)

FOREIGN PATENT DOCUMENTS

WO 2009093038 7/2009

*Primary Examiner* — Benjamin F Fiorello

(57) ABSTRACT

The inflatable flood barrier is a temporary dike. The inflatable flood barrier forms a water impermeable barrier that contains and controls the flow of flood water. The inflatable flood barrier is a temporary structure that can move as required for the control of flood water. The inflatable flood barrier comprises a plurality of curtains, a plurality of floating bladders, a plurality of bed bladders, and a plurality of fasteners. The each of the plurality of fasteners attaches a first curtain selected from the plurality of curtains to a second curtain selected from the plurality of curtains. The plurality of floating bladders forms a floatation structure that raises the plurality of curtains to form a vertical barrier that contains and controls the flow of flood water. The plurality of bed bladders anchors the inflatable flood barrier to the flood bed.

16 Claims, 6 Drawing Sheets

(56) References Cited

U.S. PATENT DOCUMENTS

| | | | | |
|---|---|---|---|---|
| 9,745,795 | B2 | 8/2017 | Su | |
| 2008/0008533 | A1* | 1/2008 | Rehn | E04H 9/145 405/114 |
| 2010/0310315 | A1 | 12/2010 | James | |
| 2013/0302092 | A1* | 11/2013 | Ortiz | E06B 9/00 405/36 |

* cited by examiner

INFLATABLE FLOOD BARRIER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hydraulic engineering including structures for protecting banks, coasts, and harbors, more specifically, a temporary dike with a filling.

SUMMARY OF INVENTION

The inflatable flood barrier is a temporary dike. The inflatable flood barrier forms a water impermeable barrier that contains and controls the flow of flood water. The inflatable flood barrier is a temporary structure that can move as required for the control of flood water. The inflatable flood barrier comprises a plurality of curtains, a plurality of floating bladders, a plurality of bed bladders, and a plurality of fasteners. The each of the plurality of fasteners attaches a first curtain selected from the plurality of curtains to a second curtain selected from the plurality of curtains. The plurality of floating bladders forms a floatation structure that raises the plurality of curtains to form a vertical barrier that contains and controls the flow of flood water. The plurality of bed bladders anchors the inflatable flood barrier to the flood bed.

These together with additional objects, features and advantages of the inflatable flood barrier will be readily apparent to those of ordinary skill in the art upon reading the following detailed description of the presently preferred, but nonetheless illustrative, embodiments when taken in conjunction with the accompanying drawings.

In this respect, before explaining the current embodiments of the inflatable flood barrier in detail, it is to be understood that the inflatable flood barrier is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the inflatable flood barrier.

It is therefore important that the claims be regarded as including such equivalent construction insofar as they do not depart from the spirit and scope of the inflatable flood barrier. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
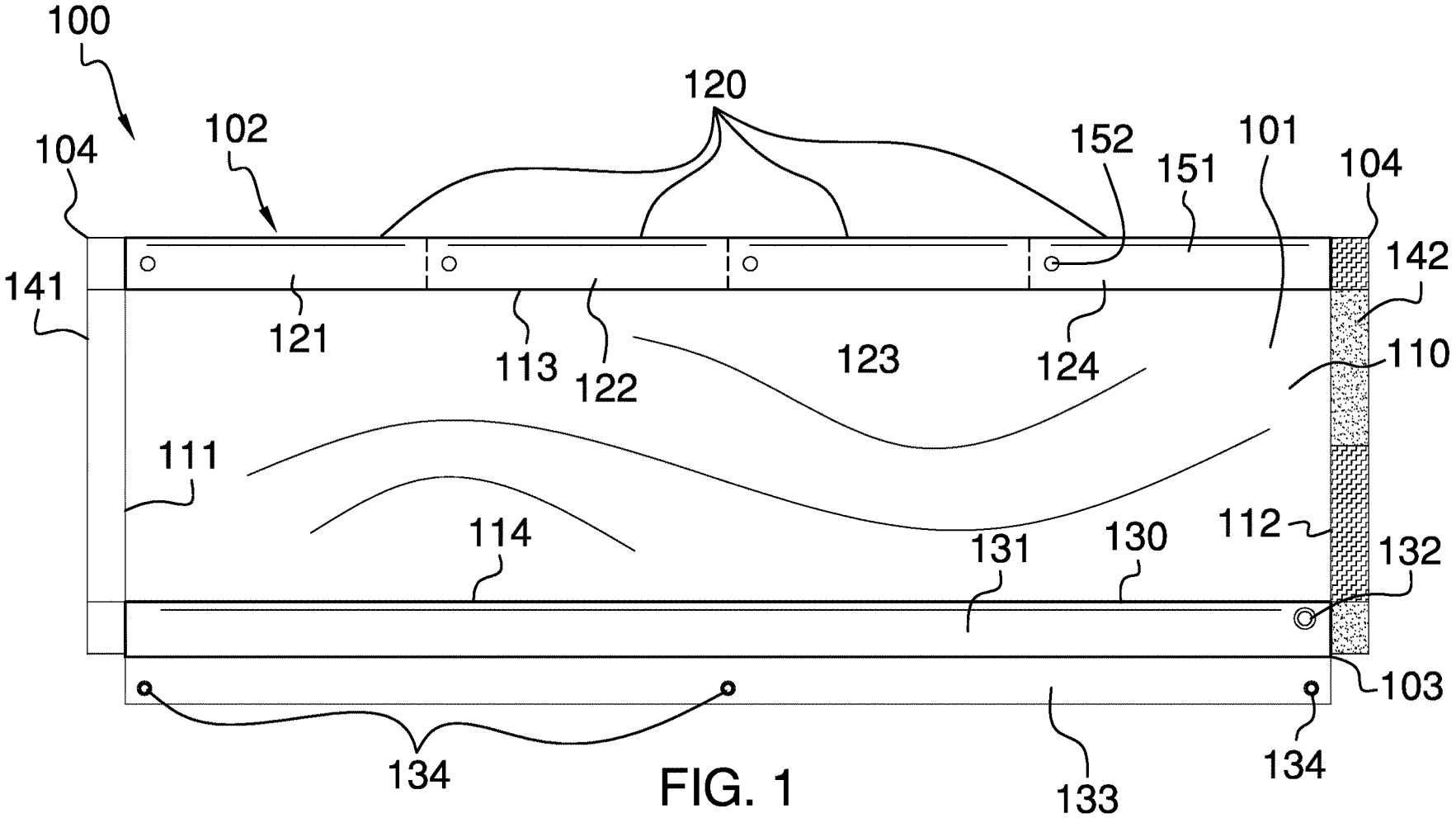
FIG. 1 is a front view of an embodiment of the disclosure.
Figure 2:
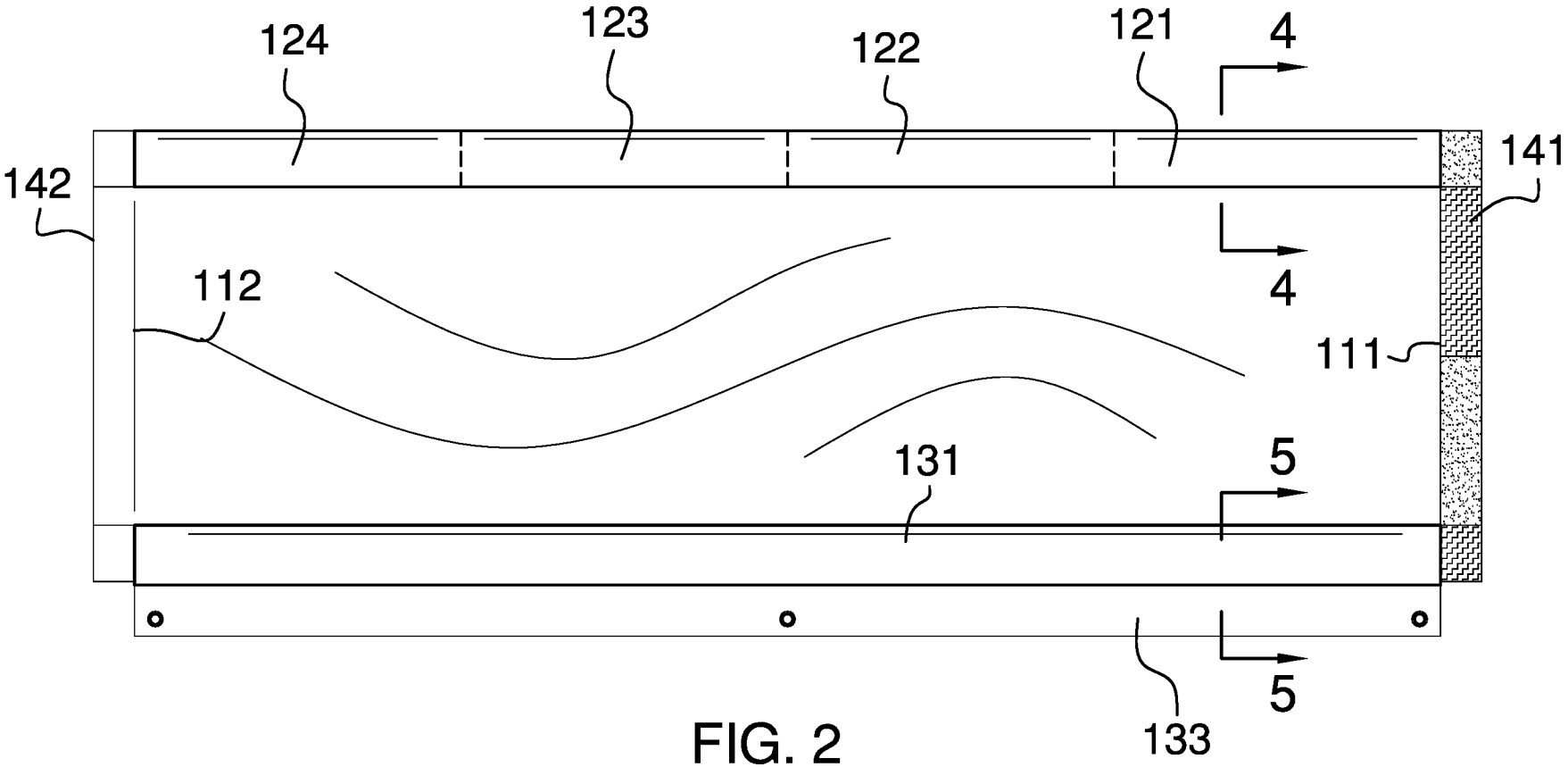
FIG. 2 is a rear view of an embodiment of the disclosure.
Figure 4:
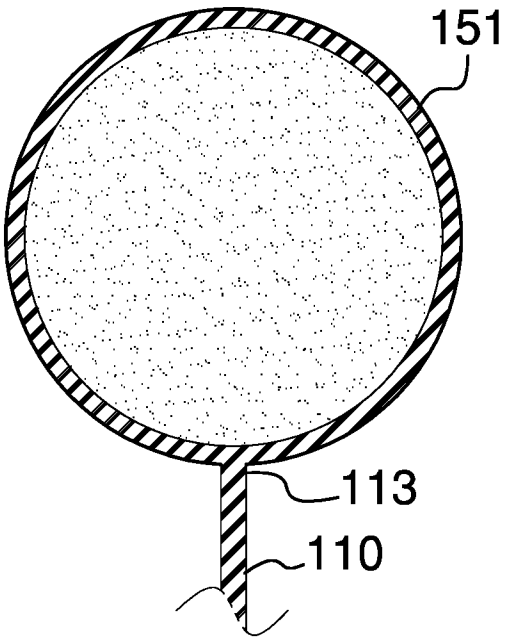
FIG. 4 is a cross-sectional view of an embodiment of the disclosure across 4-4 as shown in FIG. 2.
Figure 3:
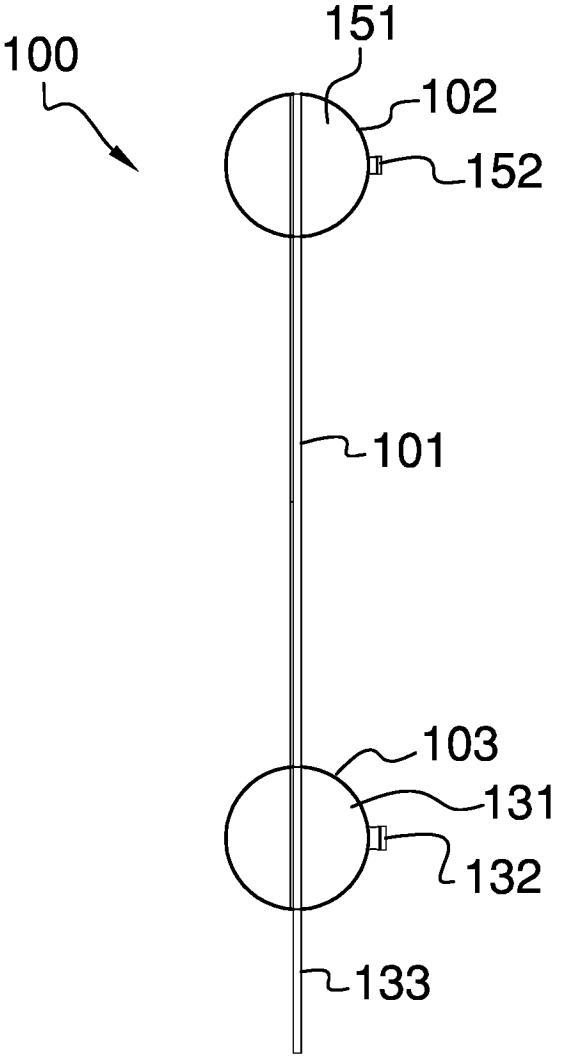
FIG. 3 is a side view of an embodiment of the disclosure.
Figure 5:
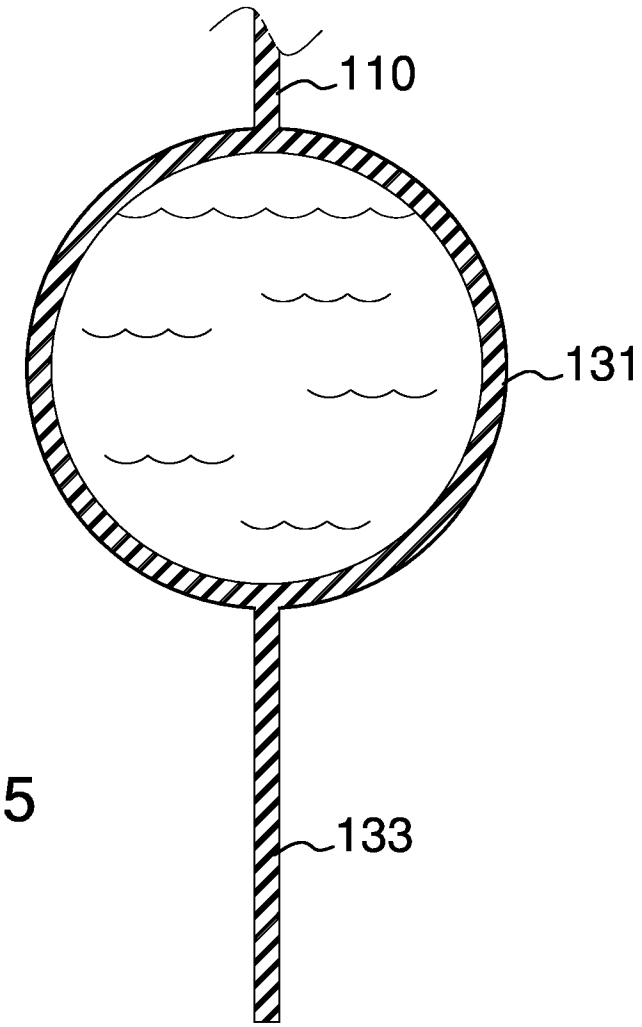
FIG. 5 is a cross-sectional view of an embodiment of the disclosure across 5-5 as shown in FIG. 2.
Figure 6:
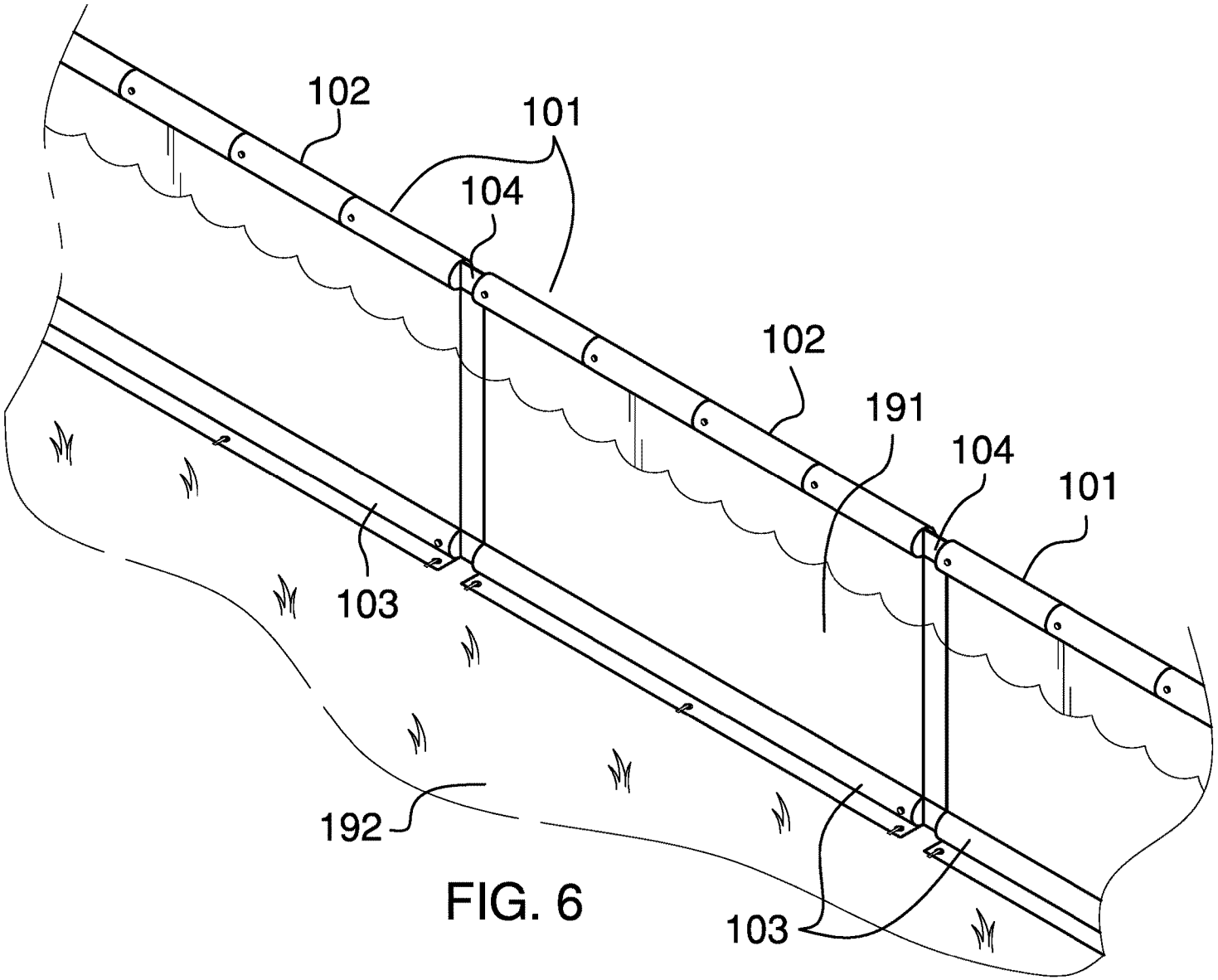
FIG. 6 is an in-use view of an embodiment of the disclosure.
Figure 7:
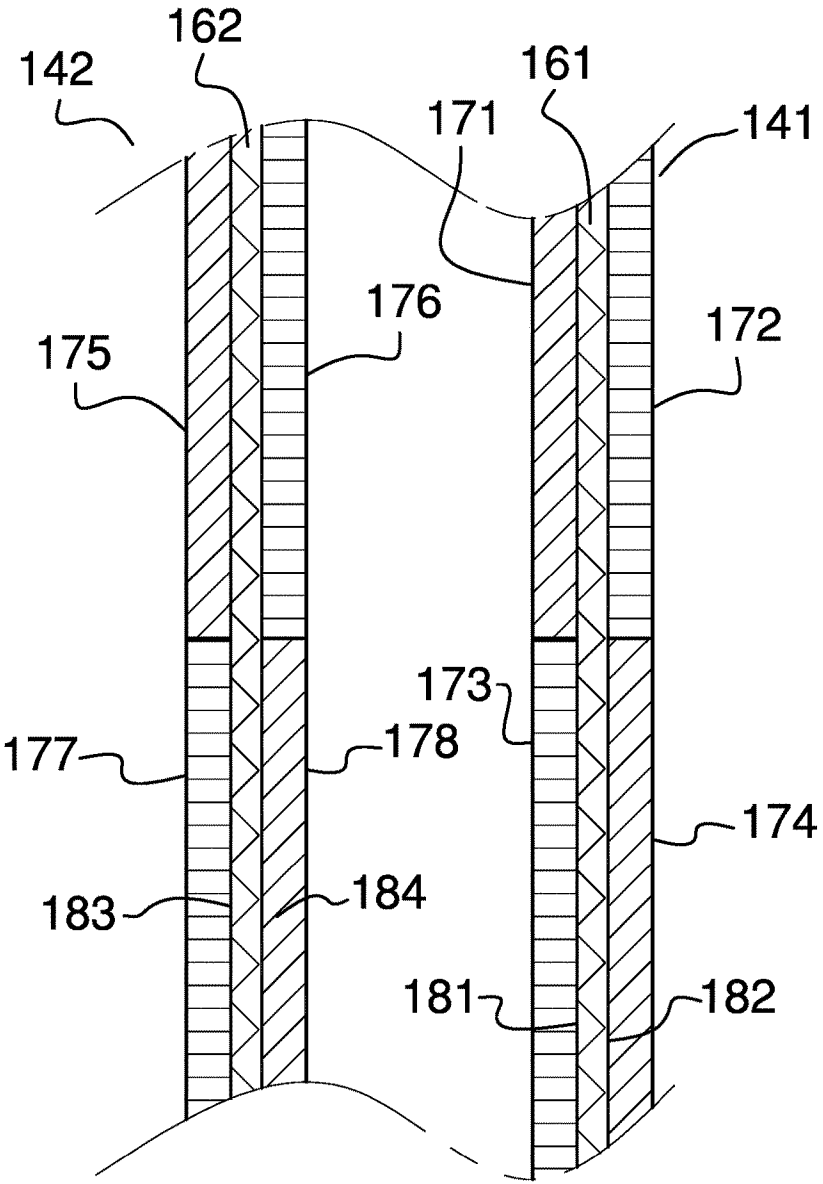
FIG. 7 is a detail view of an embodiment of the disclosure.

Detailed reference will now be made to one or more potential embodiments of the disclosure, which are illustrated in FIGS. 1 through 7.

The inflatable flood barrier 100 (hereinafter invention) is a temporary dike. The invention 100 forms a water impermeable barrier that contains and controls the flow of flood water 191. The invention 100 is a temporary structure that can be move as required for the control of flood water 191. The invention 100 comprises a plurality of curtains 101, a plurality of floating bladders 102, a plurality of bed bladders 103, and a plurality of fasteners 104. The each of the plurality of fasteners 104 attaches a first curtain selected from the plurality of curtains 101 to a second curtain selected from the plurality of curtains 101. The interconnection of the plurality of curtains 101 allows for the formation of boundary structures used to contain and control the flow of flood water 191. The plurality of floating bladders 102 forms a floatation structure that raises the plurality of curtains 101 to form a vertical barrier that contains and controls the flow of flood water 191. The plurality of bed bladders 103 anchor the invention 100 to the flood bed 192.

The plurality of curtains 101 forms a vertically oriented water impermeable barrier that contains and controls the flow of flood water 191. Each of the plurality of curtains 101 is interconnected to form a barrier that contains and controls the flow of flood water 191. The plurality of curtains 101 comprises a plurality of identical rectangular barrier sheeting 110.

The rectangular barrier sheeting 110 is a commercially available sheeting. The rectangular barrier sheeting 110 is a fluid impermeable sheeting. The rectangular barrier sheeting 110 is cut in a rectangular shape. Each rectangular barrier sheeting 110 further comprises a first vertical edge 111, a second vertical edge 112, a superior edge 113, and an inferior edge 114.

The inferior edge 114 is the edge of the rectangular barrier sheeting 110 that is proximal to the flood bed 192 when the invention 100 is deployed. The superior edge 113 is the edge of the rectangular barrier sheeting 110 that is distal from the inferior edge 114. The superior edge 113 and the inferior edge 114 are perpendicular to the force of gravity when the invention 100 is deployed. The first vertical edge 111 is an edge of the rectangular barrier sheeting 110 that: a) runs from the superior edge 113 to the inferior edge 114 and; b) that is perpendicular to the force of gravity. The second vertical edge 112 is the edge of the rectangular barrier sheeting 110 that is parallel to and distal from the first vertical edge 111.

The plurality of floating bladders 102 forms a floating structure that raises the plurality of curtains 101 such that the rising of the flood water 191 will raise the plurality of curtains 101. Each of the plurality of floating bladders 102 raise the plurality of curtains 101 such that each of the plurality of curtains 101 form a portion of the barrier that allows the invention 100 to contain and control the flow of flood water 191. The plurality of floating bladders 102 comprises a plurality of identical individual floating bladders 120.

The individual floating bladder 120 is an inflatable structure. Each individual floating bladder 120 inflates into a prism-shaped structure. The individual floating bladder 120 is designed to receive atmospheric gas under pressure. Each individual floating bladder 120 is designed to float in flood water 191. Each individual floating bladder 120 attaches to the superior edge 113 of the rectangular barrier sheeting 110 such that the flotation of the individual floating bladder 120 raises the rectangular barrier sheeting 110. Each individual floating bladder 120 comprises a buoy structure 151 and a buoy valve 152.

The buoy structure 151 is the inflatable prism-shaped structure of each floating bladder selected from the plurality of floating bladders 102. The buoy structure 151 attaches directly to the superior edge 113 of the rectangular barrier sheeting 110. The buoy structure 151 is inflated in order to float the rectangular barrier sheeting 110. The buoy valve 152 is a commercially available valve. The buoy valve 152 controls the flow of water into and out of the buoy structure 151.

The plurality of floating bladders 102 further comprises a first buoy 121, a second buoy 122, a third buoy 123, and a fourth buoy 124.

The first buoy 121 is a floating bladder selected from the plurality of floating bladders 102. The first buoy 121 attaches to the superior edge 113 at a position proximal to the first vertical edge 111 and next to the second buoy 122. The second buoy 122 is a floating bladder selected from the plurality of floating bladders 102. The second buoy 122 attaches to the superior edge 113 at a position between the first buoy 121 and the third buoy 123. The third buoy 123 is a floating bladder selected from the plurality of floating bladders 102. The third buoy 123 attaches to the superior edge 113 at a position between the second buoy 122 and the fourth buoy 124. The fourth buoy 124 is a floating bladder selected from the plurality of floating bladders 102. The fourth buoy 124 attaches to the superior edge 113 at a position proximal to the second vertical edge 112 and next to the third buoy 123.

The plurality of bed bladders 103 forms an anchoring structure that attaches the plurality of curtains 101 to the flood bed 192 of the flood water 191. Each of the plurality of bed bladders 103 anchors a curtain selected from the plurality of curtains 101 to the flood bed 192 of the flood water 191. The plurality of bed bladders 103 comprises a plurality of identical individual bed bladders 130.

The individual bed bladder 130 is a collapsible water impermeable structure. Each individual bed bladder 130 expands into a prism-shaped structure. The individual bed bladder 130 anchors a curtain selected from the plurality of curtains 101 to the flood bed 192. The individual bed bladder 130 is filled with water such that the individual bed bladder 130 will not shift position when the invention 100 is prepared for flood water 191. Each individual bed bladder 130 comprises a bed bladder structure 131, a bed bladder valve 132, and an anchor strip 133. The anchor strip 133 further comprises a plurality of grommets 134.

The bed bladder structure 131 is a fluid impermeable prism-shaped structure. The bed bladder structure 131 is a hollow and collapsible structure. The bed bladder structure 131 contains the water that stabilizes the individual bed bladder 130 during the installation of the invention 100. The bed bladder valve 132 is a commercially available valve. The bed bladder valve 132 controls the flow of water into and out of the bed bladder structure 131.

The anchor strip 133 is a rectangular sheeting that attaches to the exterior surface of the bed bladder structure 131. The anchor strip 133 forms a plurality of anchor points that allow the bed bladder structure 131 to be anchored to the anticipated flood bed 192 as the invention 100 is prepared for the flood water 191. Each of the plurality of grommets 134 is a commercially available grommet. Each of the plurality of grommets 134 is installed in the anchor strip 133. Each of the plurality of grommets 134 forms an anchor point that allows the anchor strip 133 to be tied down to the anticipated flood bed 192 using cord and stakes as the invention 100 is prepared for the flood water 191.

The plurality of fasteners 104 are fasteners used to interconnect the plurality of curtains 101. Each of the plurality of fasteners 104 is a fastening device that attaches a first curtain selected from the plurality of curtains 101 to a second curtain selected from the plurality of curtains 101 such that the plurality of curtains 101 interconnect to form the water impermeable vertical barrier. The plurality of fasteners 104 comprises a first hook and loop structure 141 and a second hook and loop structure 142.

The first hook and loop structure 141 is a textile-based structure that attaches to the first vertical edge 111 of the rectangular barrier sheeting 110. The second hook and loop structure 142 is a textile-based structure that attaches to the second vertical edge 112 of the rectangular barrier sheeting 110. The plurality of curtains 101 interconnect by attaching the first hook and loop structure 141 of a first curtain selected from the plurality of curtains 101 to the second hook and loop structure 142 of a second curtain selected from the plurality of curtains 101.

The first hook and loop structure 141 comprises a first strap 161, a first hook/loop surface 171, a second hook/loop surface 172, a third hook/loop surface 173, and a fourth hook/loop surface 174. The first strap 161 is further defined with a first surface 181 and a second surface 182.

The first strap 161 is a commercially available textile based webbing. The first strap 161 forms the base structure of the first hook and loop structure 141.

The first hook/loop surface 171 is the hook/loop surface of a hook and loop fastener. The first hook/loop surface 171 attaches to the first strap 161. The second hook/loop surface 172 is the hook/loop surface of a hook and loop fastener. The second hook/loop surface 172 attaches to the first strap 161. The third hook/loop surface 173 is the hook/loop surface of a hook and loop fastener. The third hook/loop surface 173 attaches to the first strap 161. The fourth hook/loop surface 174 is the hook/loop surface of a hook and loop fastener. The fourth hook/loop surface 174 attaches to the first strap 161.

The first hook/loop surface 171 is selected from a first group comprising a hook surface and a loop surface. The second hook/loop surface 172 is selected from a first group such that the surface of the second hook/loop surface 172 differs from the selection of the first hook/loop surface 171 from the first group. The third hook/loop surface 173 is selected from a second group comprising a hook surface and a loop surface. The fourth hook/loop surface 174 is selected from a second group such that the surface of the fourth hook/loop surface 174 differs from the selection of the third hook/loop surface 173 from the second group.

The first hook/loop surface 171 forms a hook and loop fastener with a hook/loop surface selected from the group consisting of the fifth hook/loop surface 175, the sixth hook/loop surface 176, the seventh hook/loop surface 177, and the eighth hook/loop surface 178 of the second hook and loop structure 142.

The second hook/loop surface 172 forms a hook and loop fastener with a hook/loop surface selected from the group consisting of the fifth hook/loop surface 175, the sixth hook/loop surface 176, the seventh hook/loop surface 177, and the eighth hook/loop surface 178 of the second hook and loop structure 142.

The third hook/loop surface 173 forms a hook and loop fastener with a hook/loop surface selected from the group consisting of the fifth hook/loop surface 175, the sixth hook/loop surface 176, the seventh hook/loop surface 177, and the eighth hook/loop surface 178 of the second hook and loop structure 142.

The fourth hook/loop surface 174 forms a hook and loop fastener with a hook/loop surface selected from the group consisting of the fifth hook/loop surface 175, the sixth hook/loop surface 176, the seventh hook/loop surface 177, and the eighth hook/loop surface 178 of the second hook and loop structure 142.

The second hook and loop structure 142 comprises a second strap 162, a fifth hook/loop surface 175, a sixth hook/loop surface 176, a seventh hook/loop surface 177, and an eighth hook/loop surface 178. The second strap 162 is further defined with a third surface 183 and a fourth surface 184.

The second strap 162 is a commercially available textile based webbing. The second strap 162 forms the base structure of the second hook and loop structure 142.

The fifth hook/loop surface 175 is the hook/loop surface of a hook and loop fastener. The fifth hook/loop surface 175 attaches to the second strap 162. The sixth hook/loop surface 176 is the hook/loop surface of a hook and loop fastener. The sixth hook/loop surface 176 attaches to the second strap 162. The seventh hook/loop surface 177 is the hook/loop surface of a hook and loop fastener. The seventh hook/loop surface 177 attaches to the second strap 162. The eighth hook/loop surface 178 is the hook/loop surface of a hook and loop fastener. The eighth hook/loop surface 178 attaches to the second strap 162.

The fifth hook/loop surface 175 is selected from a third group comprising a hook surface and a loop surface. The sixth hook/loop surface 176 is selected from a third group such that the surface of the sixth hook/loop surface 176 differs from the selection of the fifth hook/loop surface 175 from the third group. The seventh hook/loop surface 177 is selected from a fourth group comprising a hook surface and a loop surface. The eighth hook/loop surface 178 is selected from a fourth group such that the surface of the eighth hook/loop surface 178 differs from the selection of the seventh hook/loop surface 177 from the fourth group.

The fifth hook/loop surface 175 forms a hook and loop fastener with a hook/loop surface selected from the group consisting of the first hook/loop surface 171, the second hook/loop surface 172, the third hook/loop surface 173, and the fourth hook/loop surface 174 of the first hook and loop structure 141.

The sixth hook/loop surface 176 forms a hook and loop fastener with a hook/loop surface selected from the group consisting of the first hook/loop surface 171, the second hook/loop surface 172, the third hook/loop surface 173, and the fourth hook/loop surface 174 of the first hook and loop structure 141.

The seventh hook/loop surface 177 forms a hook and loop fastener with a hook/loop surface selected from the group consisting of the first hook/loop surface 171, the second hook/loop surface 172, the third hook/loop surface 173, and the fourth hook/loop surface 174 of the first hook and loop structure 141.

The eighth hook/loop surface 178 forms a hook and loop fastener with a hook/loop surface selected from the group consisting of the first hook/loop surface 171, the second hook/loop surface 172, the third hook/loop surface 173, and the fourth hook/loop surface 174 of the first hook and loop structure 141.

The first hook/loop surface 171 attaches to the first surface 181 of the first strap 161. The second hook/loop surface 172 attaches to the second surface 182 of the first strap 161. The third hook/loop surface 173 attaches to the first surface 181 of the first strap 161. The fourth hook/loop surface 174 attaches to the second surface 182 of the first strap 161. The surface selected for the third hook/loop surface 173 is different from the surface selected for the first hook/loop surface 171. The surface selected for the fourth hook/loop surface 174 is different from the surface selected for the second hook/loop surface 172.

The fifth hook/loop surface 175 attaches to the third surface 183 of the second strap 162. The sixth hook/loop surface 176 attaches to the fourth surface 184 of the second strap 162. The seventh hook/loop surface 177 attaches to the third surface 183 of the second strap 162. The eighth hook/loop surface 178 attaches to the fourth surface 184 of the second strap 162. The surface selected for the seventh hook/loop surface 177 is different from the surface selected for the fifth hook/loop surface 175. The surface selected for the eighth hook/loop surface 178 is different from the surface selected for the sixth hook/loop surface 176.

The method to attach a first curtain selected from the plurality of curtains 101 to a second curtain selected from the is selected from the group of methods consisting of: a) pressing the first hook/loop surface 171 of the first hook and loop structure 141 of the first curtain into the sixth hook/loop surface 176 of the second hook and loop structure 142 of the second curtain; while simultaneously, pressing the third hook/loop surface 173 of the first curtain of the first hook and loop structure 141 into the eighth hook/loop surface 178 of the second hook and loop structure 142; and, b) pressing the second hook/loop surface 172 of the first hook and loop structure 141 of the first curtain into the fifth hook/loop surface 175 of the second hook and loop structure 142 of the second curtain; while simultaneously, pressing the fourth hook/loop surface 174 of the first curtain of the first hook and loop structure 141 into the seventh hook/loop surface 177 of the second hook and loop structure 142.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Bed: As used in this disclosure, a bed refers to the ground that forms the bottom of a body of water. Ground that is temporarily submerged under water is referred to as a flood bed.

Bladder: As used in this disclosure, a bladder is gas impermeable structure. The internal volume of the structure can be varied by: varying the pressure and/or quantity of a gas contained within the bladder; or 2) varying the quantity of a liquid contained within the bladder. Bladders are commonly used for storage of a gas or liquid and as a cushion.

Buoy: As used in this disclosure, a buoy is a floating structure that is anchored into position in water. A buoy is used for marking a location and for assisting an object to float.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Fastener: As used in this disclosure, a fastener is a device that is used to join or affix two objects. Fasteners generally comprise a first element which is attached to the first object and a second element which is attached to the second object such that the first element and the second element join to removably attach the first object and the second object. Common fasteners include, but are not limited to, hooks, zippers, magnets, snaps, buttons, buckles, quick release buckles, or hook and loop fasteners.

Flood: As used in this disclosure, a flood refers to a large volume of water that has escaped its normal containment space.

Fluid: As used in this disclosure, a fluid refers to a state of matter wherein the matter is capable of flow and takes the shape of a container it is placed within. The term fluid commonly refers to a liquid or a gas.

Gas: As used in this disclosure, a gas refers to a state (phase) of matter that is fluid and that fills the volume of the structure that contains it. Stated differently, the volume of a gas always equals the volume of its container.

Grommet: As used in this disclosure, a grommet is an eyelet placed in a hole in a textile, sheet, or panel that protects a rope hook or cable passed through it and to protect the textile, sheet, or panel from being torn.

Ground: As used in this disclosure, the ground is a solid supporting surface formed by the Earth. The term level ground means that the supporting surface formed by the ground is roughly perpendicular to the force of gravity.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Inferior: As used in this disclosure, the term inferior refers to a directional reference that is parallel to and in the same direction as the force of gravity.

Liquid: As used in this disclosure, a liquid refers to a state (phase) of matter that is fluid and that maintains, for a given pressure, a fixed volume that is independent of the volume of the container.

Load Path: As used in this disclosure, a load path refers to a chain of one or more structures that transfers a load generated by a raised structure or object to a foundation, supporting surface, or the earth.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Sheeting: As used in this disclosure, a sheeting is a material, such as a textile, a plastic, or a metal foil, in the form of a thin flexible layer or layers.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects.

Valve: As used in this disclosure, a valve is a device that is used to control the flow of a fluid (gas or liquid) through a pipe.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A temporary dike comprising:

a plurality of curtains, a plurality of floating bladders, a plurality of bed bladders, and a plurality of fasteners;

wherein the temporary dike forms a water impermeable barrier that contains and controls the flow of flood water;

wherein the flood water further comprises a flood bed;

wherein the temporary dike is a temporary structure;

wherein the each of the plurality of fasteners attaches a first curtain selected from the plurality of curtains to a second curtain selected from the plurality of curtains;

wherein the interconnection of the plurality of curtains forms a boundary structure used to contain and control the flow of flood water;

wherein the plurality of floating bladders forms a floatation structure that raises the plurality of curtains to form a vertical barrier that contains and controls the flow of flood water;

wherein the plurality of bed bladders anchor the temporary dike to the flood bed;

wherein each of the plurality of curtains are interconnected to form the boundary structure;

wherein the plurality of curtains comprises a plurality of identical rectangular barrier sheeting;

wherein the rectangular barrier sheeting is a fluid impermeable sheeting;

wherein the rectangular barrier sheeting is cut in a rectangular shape;

wherein each rectangular barrier sheeting further comprises a first vertical edge, a second vertical edge, a superior edge, and an inferior edge;

wherein the superior edge and the inferior edge are perpendicular to the force of gravity when the temporary dike is deployed;

wherein the first vertical edge is an edge of the rectangular barrier sheeting is perpendicular to the force of gravity;

wherein the second vertical edge is parallel to the first vertical edge;

wherein the plurality of fasteners comprises a first hook and loop structure and a second hook and loop structure;

wherein the first hook and loop structure is a textile-based structure that attaches to the first vertical edge of the rectangular barrier sheeting;

wherein the second hook and loop structure is a textile-based structure that attaches to the second vertical edge of the rectangular barrier sheeting;

wherein the plurality of curtains are interconnected by attaching the first hook and loop structure of a first curtain selected from the plurality of curtains to the second hook and loop structure of a second curtain selected from the plurality of curtains;

wherein the first hook and loop structure comprises a first strap, a first hook/loop surface, a second hook/loop surface, a third hook/loop surface, and a fourth hook/loop surface;

wherein the first strap is further defined with a first surface and a second surface;

wherein the first strap is a textile-based webbing;

wherein the first hook/loop surface attaches to the first strap;

wherein the second hook/loop surface attaches to the first strap;

wherein the third hook/loop surface attaches to the first strap;

wherein the fourth hook/loop surface attaches to the first strap;

wherein the first hook/loop surface is the hook/loop surface of a hook and loop fastener;

wherein the second hook/loop surface is the hook/loop surface of a hook and loop fastener;

wherein the third hook/loop surface is the hook/loop surface of a hook and loop fastener;

wherein the fourth hook/loop surface is the hook/loop surface of a hook and loop fastener;

wherein the second hook and loop structure comprises a second strap, a fifth hook/loop surface, a sixth hook/loop surface, a seventh hook/loop surface, and an eighth hook/loop surface;

wherein the second strap is further defined with a third surface and a fourth surface;

wherein the second strap is a textile-based webbing;

wherein the fifth hook/loop surface attaches to the second strap;

wherein the sixth hook/loop surface attaches to the second strap;

wherein the seventh hook/loop surface attaches to the second strap;

wherein the eighth hook/loop surface attaches to the second strap;

wherein the fifth hook/loop surface is the hook/loop surface of a hook and loop fastener;

wherein the sixth hook/loop surface is the hook/loop surface of a hook and loop fastener;

wherein the seventh hook/loop surface is the hook/loop surface of a hook and loop fastener;

wherein the eighth hook/loop surface is the hook/loop surface of a hook and loop fastener.

2. The temporary dike according to claim 1 wherein the plurality of floating bladders forms a floating structure;

wherein the plurality of floating bladders raise the plurality of curtains such that the rising of the flood water will raise the plurality of curtains;

wherein the plurality of floating bladders comprises a plurality of identical individual floating bladders.

3. The temporary dike according to claim 2 wherein the plurality of bed bladders forms an anchoring structure that attaches the plurality of curtains to the flood bed of the flood water;

wherein each of the plurality of bed bladders anchors a curtain selected from the plurality of curtains to the flood bed of the flood water;

wherein the plurality of bed bladders comprises a plurality of identical individual bed bladders.

4. The temporary dike according to claim 3 wherein the individual bed bladder is a collapsible water impermeable structure;

wherein each individual bed bladder expands into a prism-shaped structure;

wherein the individual bed bladder anchors a curtain selected from the plurality of curtains to the flood bed;

wherein the individual bed bladder is filled with water such that the individual bed bladder will not shift position when the temporary dike is being prepared for flood water.

5. The temporary dike according to claim 4 wherein the plurality of fasteners interconnect the plurality of curtains;

wherein each of the plurality of fasteners attaches a first curtain selected from the plurality of curtains to a second curtain selected from the plurality of curtains such that the plurality of curtains interconnect to form the water impermeable vertical barrier.

6. The temporary dike according to claim 5 wherein the individual floating bladder is an inflatable structure;

wherein each individual floating bladder inflates into a prism-shaped structure;

wherein each individual floating bladder to receives atmospheric gas under pressure;

wherein each individual floating bladder floats in flood water;

wherein each individual floating bladder attaches to the superior edge of the rectangular barrier sheeting such that the flotation of the individual floating bladder raises the rectangular barrier sheeting.

7. The temporary dike according to claim 6 wherein each individual floating bladder comprises a buoy structure and a buoy valve;

wherein the buoy valve installs in the buoy structure.

8. The temporary dike according to claim 7 wherein the buoy structure is the inflatable prism-shaped structure of each floating bladder selected from the plurality of floating bladders;

wherein the buoy structure attaches directly to the superior edge of the rectangular barrier sheeting;

wherein the buoy structure is inflated;

wherein the buoy valve controls the flow of water into and out of the buoy structure.

9. The temporary dike according to claim 8 wherein each individual bed bladder comprises a bed bladder structure, a bed bladder valve, and an anchor strip;

wherein the bed bladder valve installs in the bed bladder;

wherein the anchor strip attaches to the bed bladder.

10. The temporary dike according to claim 9 wherein the bed bladder structure is a fluid impermeable prism-shaped structure;

wherein the bed bladder structure is a hollow and collapsible structure;

wherein the bed bladder structure contains the water that stabilizes the individual bed bladder during the installation of the temporary dike;

wherein the bed bladder valve controls the flow of water into and out of the bed bladder structure.

11. The temporary dike according to claim 10 wherein the anchor strip is a rectangular sheeting;

wherein the anchor strip attaches to the exterior surface of the bed bladder structure;

wherein the anchor strip forms a plurality of anchor points that allow the bed bladder structure to be anchored to the anticipated flood bed as the temporary dike is prepared for the flood water.

12. The temporary dike according to claim 11 wherein the anchor strip further comprises a plurality of grommets;

wherein each of the plurality of grommets is installed in the anchor strip;

wherein each of the plurality of grommets forms an anchor point that allows the anchor strip to be tied down to the anticipated flood bed.

13. The temporary dike according to claim 12 wherein the first hook/loop surface is selected from a first group comprising a hook surface and a loop surface;

wherein the second hook/loop surface is selected from a first group such that the surface of the second hook/loop surface differs from the selection of the first hook/loop surface from the first group;

wherein the third hook/loop surface is selected from a second group comprising a hook surface and a loop surface;

wherein the fourth hook/loop surface is selected from a second group such that the surface of the fourth hook/loop surface differs from the selection of the third hook/loop surface from the second group;

wherein the fifth hook/loop surface is selected from a third group comprising a hook surface and a loop surface;

wherein the sixth hook/loop surface is selected from a third group such that the surface of the sixth hook/loop surface differs from the selection of the fifth hook/loop surface from the third group;

wherein the seventh hook/loop surface is selected from a fourth group comprising a hook surface and a loop surface;

wherein the eighth hook/loop surface is selected from a fourth group such that the surface of the eighth hook/loop surface differs from the selection of the seventh hook/loop surface from the fourth group.

14. The temporary dike according to claim 13 wherein the first hook/loop surface forms a hook and loop fastener with a hook/loop surface selected from the group consisting of the fifth hook/loop surface, the sixth hook/loop surface, the seventh hook/loop surface, and the eighth hook/loop surface of the second hook and loop structure;

wherein the second hook/loop surface forms a hook and loop fastener with a hook/loop surface selected from the group consisting of the fifth hook/loop surface, the sixth hook/loop surface, the seventh hook/loop surface, and the eighth hook/loop surface of the second hook and loop structure;

wherein the third hook/loop surface forms a hook and loop fastener with a hook/loop surface selected from the group consisting of the fifth hook/loop surface, the sixth hook/loop surface, the seventh hook/loop surface, and the eighth hook/loop surface of the second hook and loop structure;

wherein the fourth hook/loop surface forms a hook and loop fastener with a hook/loop surface selected from the group consisting of the fifth hook/loop surface, the sixth hook/loop surface, the seventh hook/loop surface, and the eighth hook/loop surface of the second hook and loop structure;

wherein the fifth hook/loop surface forms a hook and loop fastener with a hook/loop surface selected from the group consisting of the first hook/loop surface, the second hook/loop surface, the third hook/loop surface, and the fourth hook/loop surface of the first hook and loop structure;

wherein the sixth hook/loop surface forms a hook and loop fastener with a hook/loop surface selected from the group consisting of the first hook/loop surface, the second hook/loop surface, the third hook/loop surface, and the fourth hook/loop surface of the first hook and loop structure;

wherein the seventh hook/loop surface forms a hook and loop fastener with a hook/loop surface selected from the group consisting of the first hook/loop surface, the second hook/loop surface, the third hook/loop surface, and the fourth hook/loop surface of the first hook and loop structure;

wherein the eighth hook/loop surface forms a hook and loop fastener with a hook/loop surface selected from the group consisting of the first hook/loop surface, the second hook/loop surface, the third hook/loop surface, and the fourth hook/loop surface of the first hook and loop structure.

15. The temporary dike according to claim 14 wherein the first hook/loop surface attaches to the first surface of the first strap;

wherein the second hook/loop surface attaches to the second surface of the first strap;

wherein the third hook/loop surface attaches to the first surface of the first strap;

wherein the fourth hook/loop surface attaches to the second surface of the first strap;

wherein the surface selected for the third hook/loop surface is different from the surface selected for the first hook/loop surface;

wherein the surface selected for the fourth hook/loop surface is different from the surface selected for the second hook/loop surface;

wherein the fifth hook/loop surface attaches to the third surface of the second strap;

wherein the sixth hook/loop surface attaches to the fourth surface of the second strap;

wherein the seventh hook/loop surface attaches to the third surface of the second strap;

wherein the eighth hook/loop surface attaches to the fourth surface of the second strap;

wherein the surface selected for the seventh hook/loop surface is different from the surface selected for the fifth hook/loop surface;

wherein the surface selected for the eighth hook/loop surface is different from the surface selected for the sixth hook/loop surface.

16. The temporary dike according to claim 15 wherein the plurality of floating bladders further comprises a first buoy, a second buoy, a third buoy, and a fourth buoy;

wherein the first buoy is a floating bladder selected from the plurality of floating bladders;

wherein the second buoy is a floating bladder selected from the plurality of floating bladders;

wherein the third buoy is a floating bladder selected from the plurality of floating bladders;

wherein the fourth buoy is a floating bladder selected from the plurality of floating bladders;

wherein the first buoy attaches to the superior edge at a position proximal to the first vertical edge and next to the second buoy;

wherein the second buoy attaches to the superior edge at a position between the first buoy and the third buoy;

wherein the third buoy attaches to the superior edge at a position between the second buoy and the fourth buoy;

wherein the fourth buoy attaches to the superior edge at a position proximal to the second vertical edge and next to the third buoy.

* * * * *